US008572833B2

(12) United States Patent
Ly et al.

(10) Patent No.: US 8,572,833 B2
(45) Date of Patent: Nov. 5, 2013

(54) METHOD AND APPARATUS FOR RETAINING AN ORNAMENT

(75) Inventors: Tho Ly, Plattsburgh, NY (US); Andrew Schuyler, Colchester, VT (US)

(73) Assignee: Swarovski Lighting, Ltd., Plattsburgh, NY (US)

( * ) Notice: Subject to any disclaimer, the term of this patent is extended or adjusted under 35 U.S.C. 154(b) by 418 days.

(21) Appl. No.: 12/767,238

(22) Filed: Apr. 26, 2010

(65) Prior Publication Data

US 2011/0258832 A1 Oct. 27, 2011

(51) Int. Cl.
*F21V 17/16* (2006.01)
*B21K 1/20* (2006.01)

(52) U.S. Cl.
USPC ..... 29/509; 29/505; 29/243.58; 29/243.5; 29/283.5; 29/818; 29/816; 29/270; 362/382; 362/806; 248/224.8

(58) Field of Classification Search
USPC ..... 29/505, 247, 249, 402.07, 832, 825, 29/827, 852, 509, 243.58, 243.5, 283.5, 29/818, 816, 270; 439/45, 46, 566, 736, 439/150, 324; 174/180, 182, 185, 201, 194, 174/210; 248/224.8; 362/382, 806
See application file for complete search history.

(56) References Cited

U.S. PATENT DOCUMENTS

| | | | | | |
|---|---|---|---|---|---|
| 5,144,412 | A * | 9/1992 | Chang et al. | ..... | 257/665 |
| 5,222,805 | A * | 6/1993 | Schonbek et al. | ..... | 362/405 |
| 5,258,900 | A | 11/1993 | Bayer | | |
| 5,573,330 | A * | 11/1996 | Lucas | ..... | 362/405 |
| 5,577,838 | A | 11/1996 | Lucas | | |
| 5,906,430 | A | 5/1999 | Bayer | | |
| 6,834,486 | B2 * | 12/2004 | Thompson et al. | ..... | 56/255 |
| 7,101,065 | B2 | 9/2006 | Bayer | | |
| 7,267,463 | B2 | 9/2007 | Bayer et al. | | |

* cited by examiner

*Primary Examiner* — Peter DungBa Vo
*Assistant Examiner* — Kaying Kue
(74) *Attorney, Agent, or Firm* — Heslin Rothenberg Farley & Mesiti P.C.

(57) ABSTRACT

A method and apparatus for retaining an ornament, for example, an ornamental crystal, on a frame or plate is provided. The method includes providing a pin having a first end and a second end, opposite the first end, the second end comprising a projection, for example, a head; inserting the first end of the pin through an aperture in the ornament and through a hole in the frame wherein the projection obstructs the aperture in the ornament; deforming, for example, twisting, the second end of the pin to provide a deformation of the second end that obstructs passage of the second end through the hole in the frame; and retaining the ornament on the frame by the projection of the first end of the pin and the deformation of the second end of the pin. Aspects of the invention facilitate the mounting of ornaments to ornamental fixtures, for example, chandeliers.

14 Claims, 12 Drawing Sheets

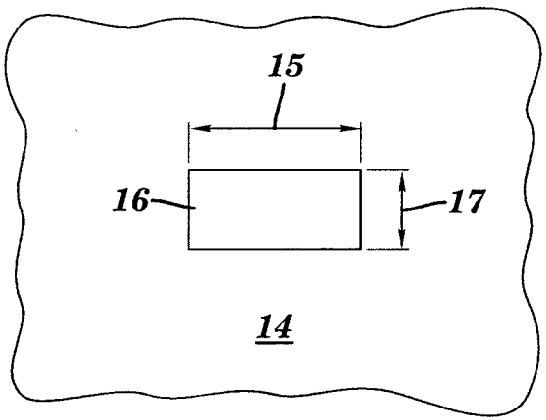
FIG. 10A
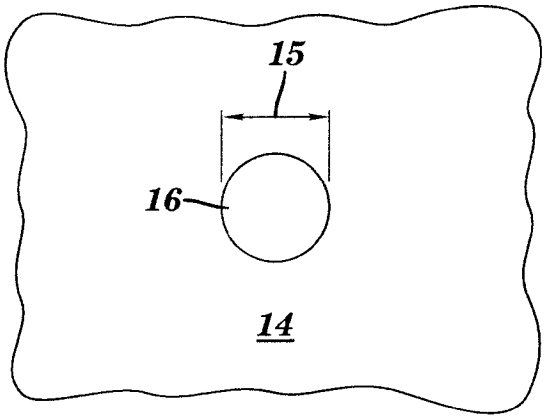
FIG. 10B
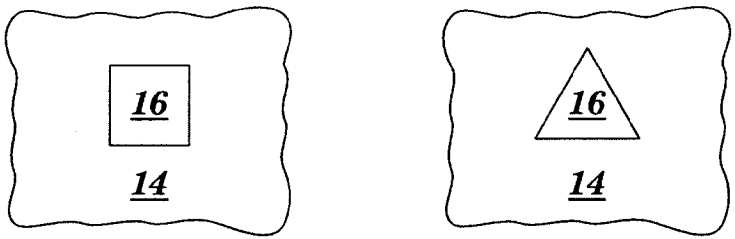
FIG. 10C
FIG. 10D
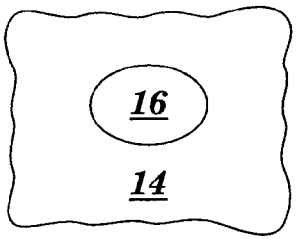
FIG. 10E
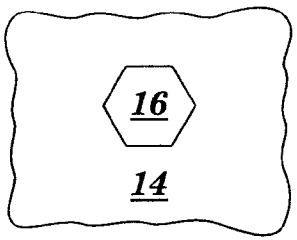
FIG. 10F

METHOD AND APPARATUS FOR RETAINING AN ORNAMENT

BACKGROUND OF THE INVENTION

1. Technical Field

The present invention generally relates to methods and apparatus for retaining ornaments on an ornamental frame. More particularly, the present invention relates to methods and apparatus for retaining ornaments on a frame by means of a pin that is passed through the ornament and the frame and then deformed to retain the ornament.

2. Description of Related Art

Designers of ornamental fixtures, for example, lighting fixtures, such as, chandeliers and wall sconces, often use ornaments to enhance the appearance of their fixtures. These ornaments may consist of any conventional ornaments, such as, ceramic beads or glass crystals, and typically include an aperture or hole that provides a point of attachment to the fixture. However, due to the fragility of these ornaments, care must be taken in mounting or retaining the ornament on the fixture, that is, to the structure or frame that provides the structural base of the fixture, without damaging the ornament or the frame.

One conventional means of mounting ornaments is by the use of wires. For example, metallic wires are often inserted through holes in ornaments and frames and then twisted to provide an obstruction to disengagement of the wire from the ornament or the frame.

One type of prior art attachment method provides a head at one end of the wire and after insertion of the wire through the ornament and the frame, the wire is twisted to form a loop or, as is commonly referred to in the art, a "pigtail." One typical "pigtail" mounting that is common in the art is shown in FIGS. 1 and 2. Other means of engaging frames or plates are disclosed in U.S. Pat. Nos. 5,258,900 and 5,577,838; however, these patents do not disclose the mounting of ornaments to frames or plates, but the engagement of plates with plates.

Aspects of the present invention provide improvements over the prior art, as will be apparent upon view of the following descriptions.

SUMMARY OF THE INVENTION

In one embodiment of the invention, a method of retaining an ornament on a frame is provided. The method may include providing a pin having a first end and a second end, opposite the first end, the second end comprising a projection; inserting the first end of the pin through an aperture in the ornament and through a hole in the frame wherein the projection obstructs the aperture in the ornament; deforming the second end of the pin to provide a deformation of the second end that obstructs passage of the second end through the hole in the frame; and retaining the ornament on the frame by the projection of the first end of the pin and the deformation of the second end of the pin. In one aspect, the practice of deforming may comprise twisting the second end of the pin about an axis of the pin. In another aspect, wherein when the pin comprises a non-circular cross section, the method may further comprise, while twisting the second end of the pin, preventing rotation of the pin in the hole of the frame. This prevention of rotation may be effected by interference between the non-circular cross section of the pin and the hole in the frame.

Another embodiment of the invention is an apparatus for retaining an ornament comprising or including a frame have a hole; a pin having a first end and a second end having a projection, the pin adapted to pass through an aperture of an ornament and through the frame hole wherein the first end extends out of the frame hole and the projection of the second end abuts the ornament; and a deformation of the second end of the pin that obstructs passage of the second end through the frame hole thereby retaining the ornament on the frame between the projection of the first end of the pin and the deformation of the second end of the pin. The deformation may be a twisting of the second end of the pin about an axis of the pin. In one aspect, the apparatus may include means for preventing rotation of the pin in the hole of the frame, for example, an internal surface of the hole positioned to interfere with the rotation of the pin within the hole. For example, the hole may be a non-circular hole, such as, a rectangular hole, and the pin may be a pin having a non-circular shaft, wherein an internal surface of the non-circular hole interferes with the rotation of the non-circular shaft.

These and other aspects, features, and advantages of this invention will become apparent from the following detailed description of the various aspects of the invention taken in conjunction with the accompanying drawings

BRIEF DESCRIPTION OF THE DRAWINGS

The subject matter, which is regarded as the invention, is particularly pointed out and distinctly claimed in the claims at the conclusion of the specification. The foregoing and other objects, features, and advantages of the invention will be readily understood from the following detailed description of aspects of the invention taken in conjunction with the accompanying drawings, in which:

FIGS. 10A through 10F are plan views of frame holes that can be used in the embodiment of the invention shown in FIG. 3.

DETAILED DESCRIPTION OF THE INVENTION

Figure 1:
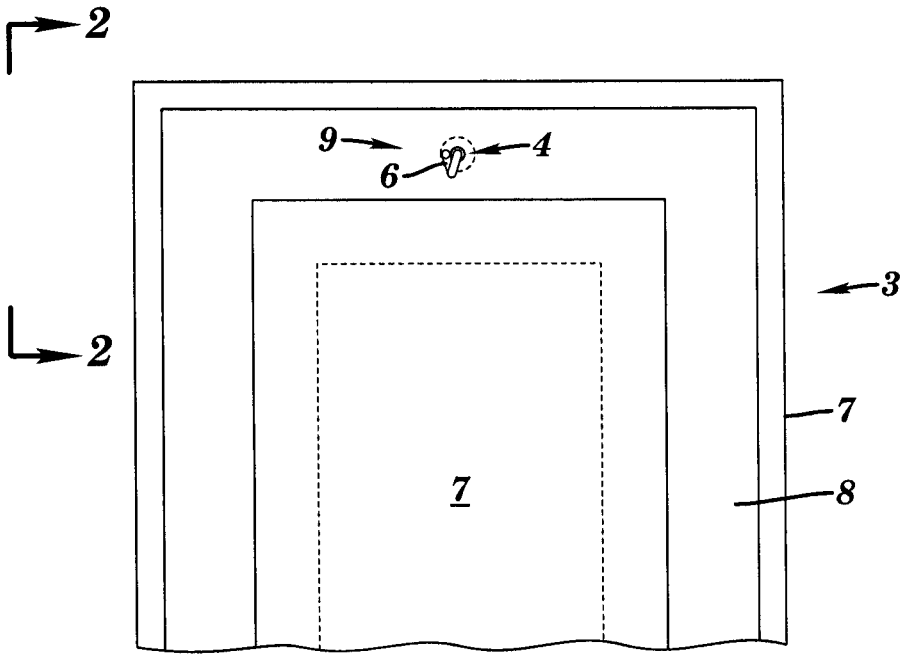
FIG. 1 PRIOR ART
FIG. 1 is a rear view of a "pigtail" ornament mounting according to the prior art.
Figure 2:
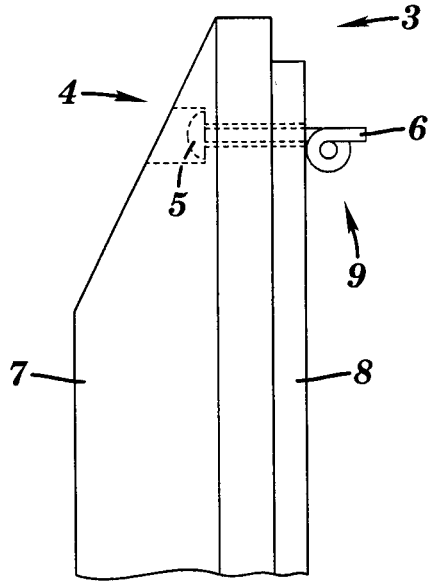
FIG. 2 PRIOR ART
FIG. 2 is side elevation view of the "pigtail" ornament mounting shown in FIG. 1 as viewed along lines 2-2 in FIG. 1.

FIG. 1 is a rear view of a "pigtail" ornament mounting 3 according to the prior art. FIG. 2 is side elevation view of the "pigtail" ornament mounting 3 shown in FIG. 1 as viewed along lines 2-2 in FIG. 1. As shown, mounting 3 comprises a pin 4 having a head 5 and a distal end 6 opposite the head 5. The distal end 6 is inserted through a hole in an ornament 7 and a frame or plate 8. After insertion, the distal end 6 of pin 4 is twisted, for example, manually with an appropriate tool, such as, a needle-nose pliers, in a circular fashion to provide the so-called "pigtail" 9. According to the prior art, the ornament 7 is retained on plate 8 between head 5 and pigtail 9.

However, it will be apparent to those of skill in the art that the manipulation of pin 4, especially, the twisting of distal end 6 to create pigtail 9 can be a cumbersome manual process. When constructing an ornamental fixture having numerous ornament mountings, such as, as chandeliers, wall sconces, lamps, and the like, the repeated insertion and twisting of retaining pins can be arduous and time consuming. In addition, the repeated manual twisting exposes the technician to potential injury. Moreover, the appearance of pigtails 9, depending upon the nature of the mounting, may provide an obstruction to or deviation from the desired aesthetic appearance of a fixture. Aspects of the present invention simplify and facilitate this ornament mounting procedure and may provide a more aesthetically pleasing ornament mounting.

Figure 3:
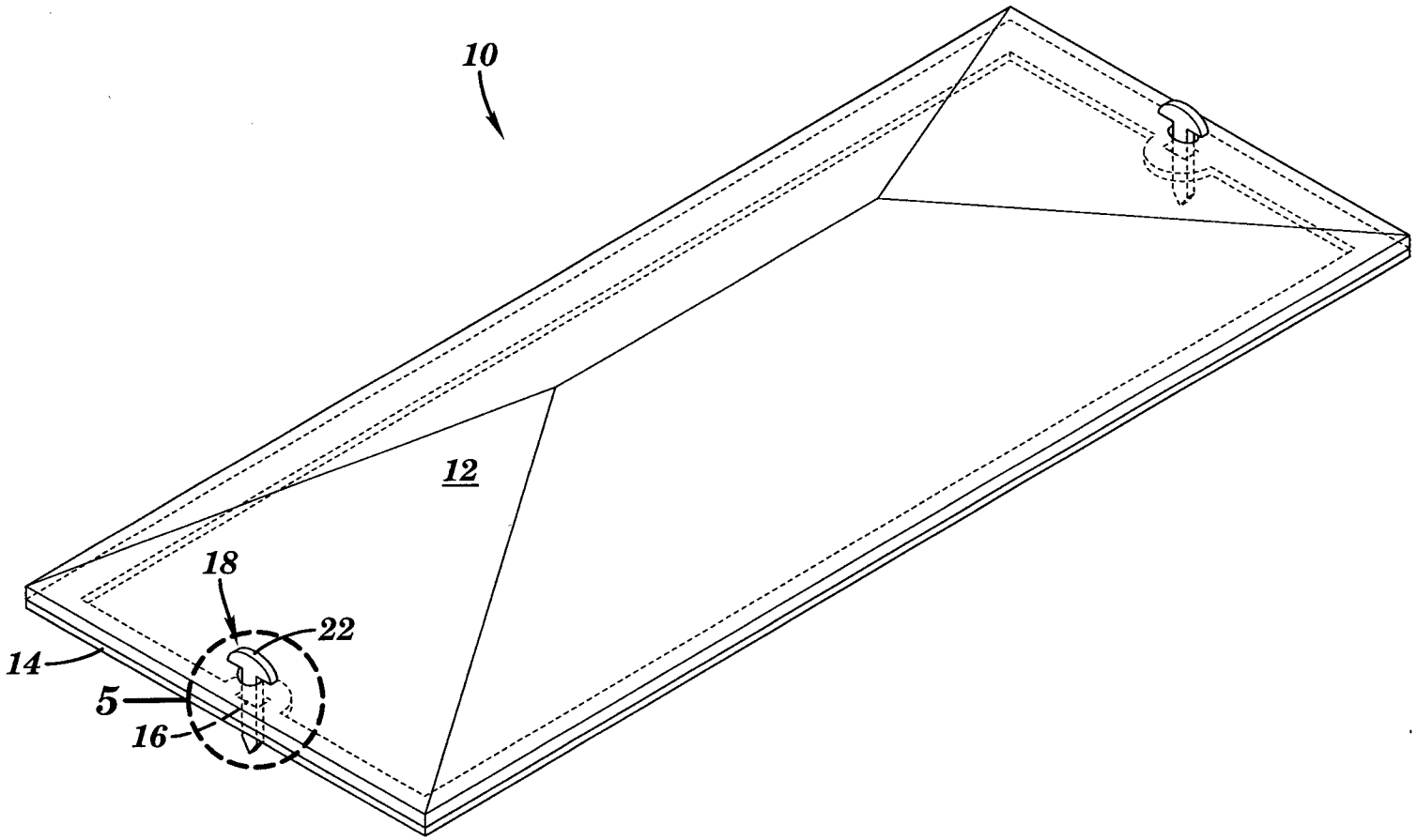
FIG. 3 is a front perspective view of one embodiment of the invention.
Figure 4:
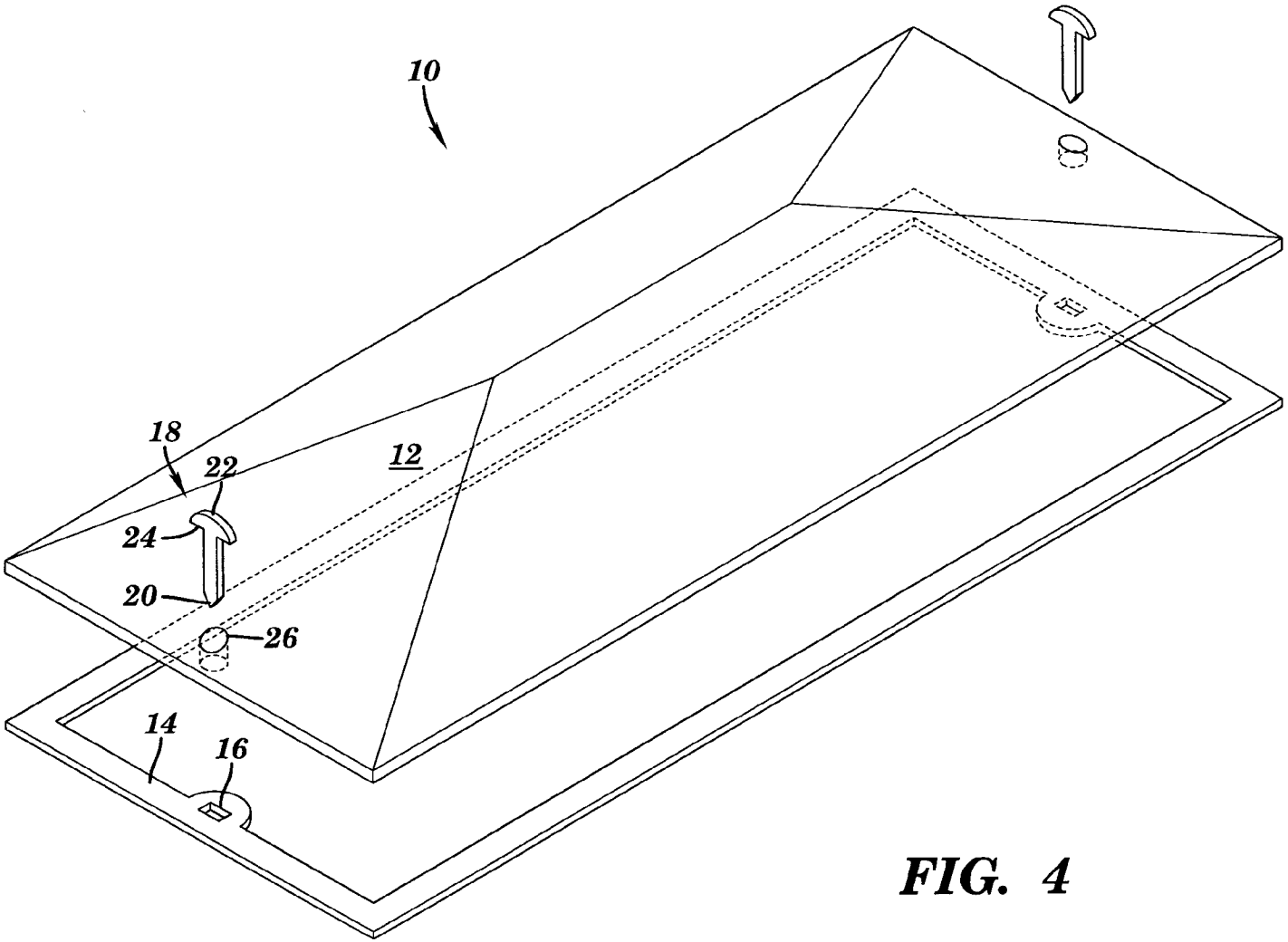
FIG. 4 is an exploded perspective view of the embodiment of the invention shown in FIG. 3.

FIG. 3 is a front perspective view of one an apparatus 10 for retaining an ornament 12 on a frame 14 according to one embodiment of the invention. FIG. 4 is an exploded perspective view of apparatus 10 shown in FIG. 3. Apparatus 10 includes at least one frame or plate 14 having a hole 16 and a pin 18, shown most clearly in FIG. 4. According to aspects of the invention, pin 18 typically has a first end 20 and a second end 22, opposite the first end 20, and the second end 22 includes at least one projection 24, as will be discussed in further detail below. Pin 18 is adapted to pass through an aperture 26 of ornament 12 and then through hole 16 in frame 14 wherein the first end 20 extends out of hole 16. Typically, the projection 24 of second end 22 abuts the ornament 12, for example, contacts a surface of ornament 12.

According to aspects of the invention, the first end 20 of pin 18 is altered, deformed, or otherwise modified as will be discussed below, to provide an alteration, modification, or deformation 28 (see FIG. 10) of first end 20 that obstructs passage of first end 20 through hole 16 in frame 14. Accordingly, ornament 12 may be at least partially retained, but typically, substantially retained, on frame 14 between projection 24 of second end 22 of pin 18 and deformation 28 of first end 22 of pin 18.

Ornament 12 may be attached to frame 14 by pin 18 at one or more locations. For example, as shown in FIGS. 3 and 4, ornament 12 may be mounted to frame 14 at two locations at either end of ornament 12. In other aspects, ornament 12 may mounted at 2 or more locations, for example, three or more locations, by pin 18.

Ornament 12, and any ornament discussed herein, may be any conventional ornament, for example, ornament 12 may be a bead, a stone, or a crystal, for instance, a faceted or non-faceted crystal, for example, a sphere, a cube, a cone, a bar, a tube, a rod, a prism, a pear, and the like, or a square, rectangular, hexagonal, or octagonal crystal, among other shapes. Ornament 12 may also be a jewel, for example, a diamond, a ruby, a sapphire, or an opal, among others. Ornament 12 may also not be a crystal, for example, ornament 12 may be a stone. Ornament 12 may be made from any suitable material, for example, glass, wood, plastic, or metal, among others. In one aspect, ornament 12 may be may be a glass crystal, for example, a crystal provided by D. Swarovski & Co. of Wattens, Austria, or its equivalent. Ornament 12 may be made from a transparent, a translucent, or an opaque material, for example, a colored glass. In one aspect of the invention, ornament 12 may also comprise illuminated ornaments, such as, lights or light-emitting diodes (LEDs).

Figure 5:
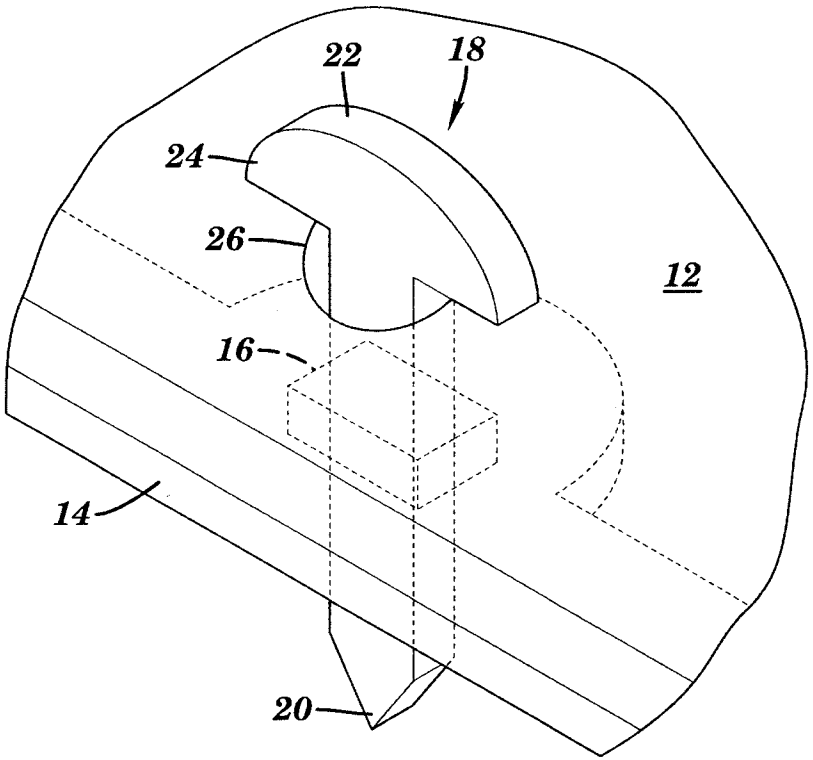
FIG. 5 is detail of the front perspective view in FIG. 3 as identified by Detail 5 in FIG. 3.
Figure 6:
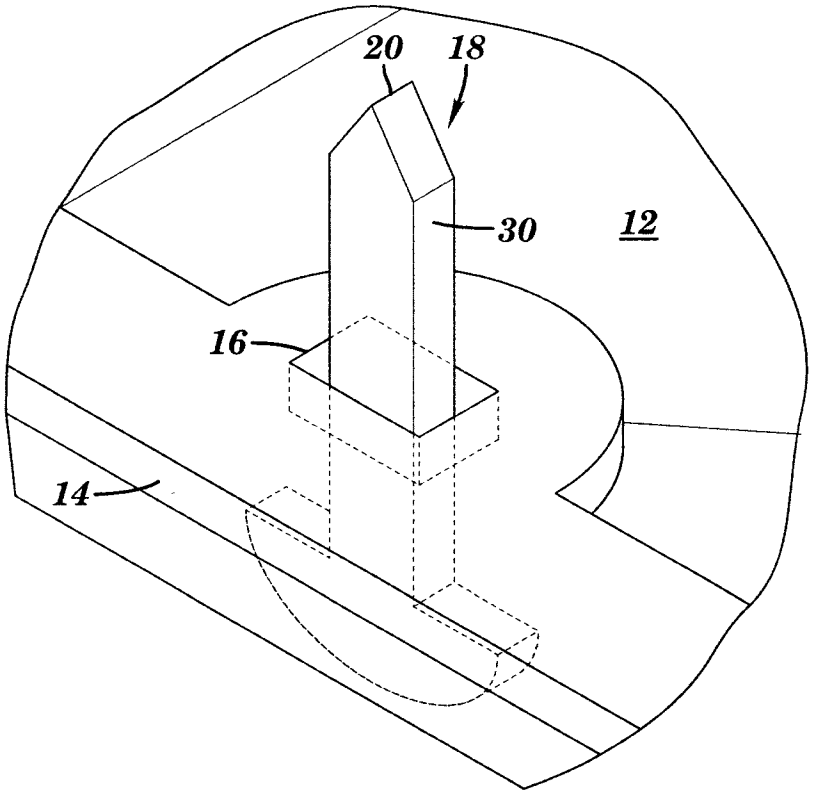
FIG. 6 is a rear perspective view of the detail shown in FIG. 5.

FIG. 5 is a detail of the front perspective view of apparatus 10 shown in FIG. 3 as identified by Detail 5 in FIG. 3. FIG. 6 is a rear perspective view of the detail of apparatus 10 shown in FIG. 5. As shown in FIG. 5, the second end 22 of pin 18 typically includes a projection 24 having a radial dimension greater than the diameter of aperture 26 of ornament 12 whereby projection 24 restricts, for example, prevents, passage of second end 22 through aperture 26. As shown in FIG. 6, the first end 20 of pin 18 may typically extend out of plate 14. As described below, end 20 may be modified, altered, or deformed to provide a deformation (not shown) having a radial dimension greater than the diameter of hole 16 of frame 14 whereby the deformation restricts, for example, prevents, passage of first end 20 through hole 16. According to aspects of the invention, the restriction provided by projection 24 and the deformation retains ornament 12 on plate 14.

Figure 7B:
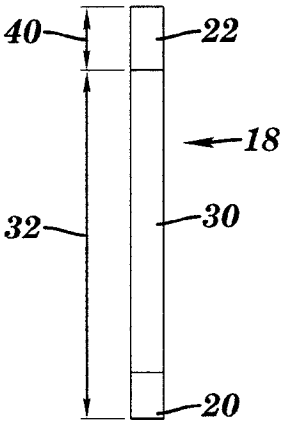
FIG. 7B is a side elevation view of the pin shown in FIG. 7A.
Figure 7A:
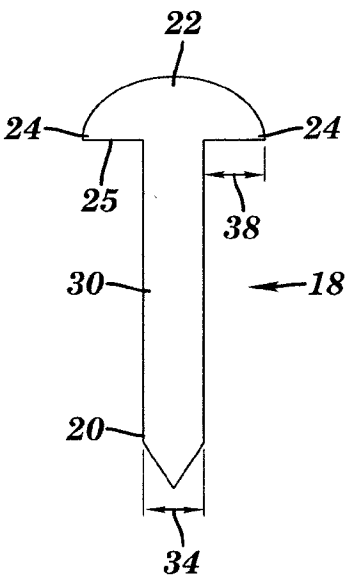
FIG. 7A is a plan view of a pin that can be used in the embodiment of the invention shown in FIGS. 3 through 6.
Figure 7C:
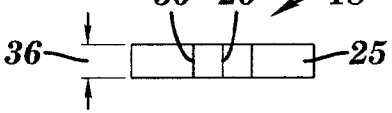
FIG. 7C is a bottom view of the pin shown in FIG. 7A.

FIG. 7A is a plan view of a pin 18 that can be used in the embodiment of the invention shown in FIGS. 3 through 6. FIG. 7B is a side elevation view of pin 18 shown in FIG. 7A. FIG. 7C is a bottom view of pin 18 shown in FIG. 7A. As shown in FIGS. 7A and 7B, pin 18 typically includes a shaft 30, a first end 20, and a second end 22, opposite first end 20. As shown, second end 22 may typically include at least one projection 24 providing a surface 25 against which ornament 12 may bear to retain ornament 12. For example, as shown in FIG. 7A, in one aspect, second end 22 may have two projections 24 mounted on opposite sides of shaft 30 providing a T-shaped appearance for pin 18. In addition second end 22 may be rounded, as shown, or otherwise contoured, for example, to provide a smooth, aesthetically attractive appearance to second end 22, for example, when pin 18 is inserted into ornament 12.

As shown in FIGS. 7B and 7C, shaft 30 of pin 18 may be rectangular in cross section, though in some aspects shaft 30 may have any polygonal-shaped cross section, for example, triangular, square, pentagonal, or hexagonal, among others. In one aspect, as shown in FIG. 7A, first end 20 may be beveled or otherwise shaped with a reduced diameter, for example, "come to a point," to assist in inserting pin 18 into aperture 26 and hole 16, though in other aspect, first end 20 may not be beveled but have a blunt end.

Shaft 30 of pin 18 may have a length 32 ranging from about 5 millimeters (mm) to about 130 mm, for example, sufficient to span the thicknesses of ornament 12 and plate 14, but is typically between about 6 mm and about 19 mm. Shaft 30 may have a width 34 ranging from about 0.5 mm to about 6 mm, for example, less than the diameter of aperture 26 of ornament 12, but is typically between about 0.5 mm and about 1.5 mm. Shaft 30 may have a thickness 36 ranging from about 0.3 mm to about 6 mm, but is typically between about 0.5 mm and about 1.5 mm.

Projection 24 from shaft 30 of pin 18 may have a length 38 ranging from about 0.5 mm to about 3 mm, for example, sufficient to obstruct passage of second end 22 through aperture 26 of ornament 12 and plate 14, but is typically between about 0.7 and about 1.2 mm. Projection 24 may also have a thickness 40 ranging from about 0.5 mm to about 12 mm, for example, sufficient to prevent bending or deflection of projection 24 under the typical loading experienced by projection 24 during assembly and use, but is typically between about 0.5 mm and about 2 mm.

Pin 18 may be made from any structural material, for example, a metal, a plastic, or even wood. For example, in one aspect where pin 18 is metallic, pin 18 may be made from iron, steel, stainless steel, aluminum, titanium, nickel, magnesium, brass, bronze, or any other structural metal, but may also be made from a precious metal, such as, copper, silver, or even gold.

Figure 8B:
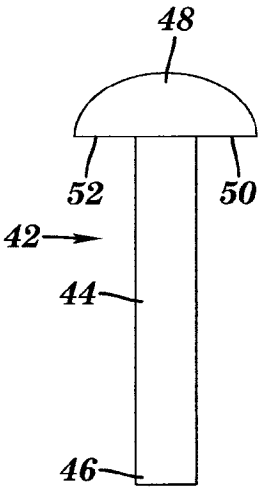
FIG. 8B is a side elevation view of the pin shown in FIG. 8A.
Figure 8A:
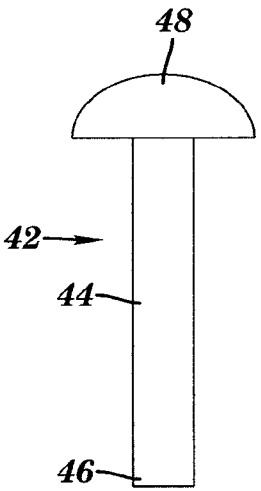
FIG. 8A is a plan view of another pin that can be used in the embodiment of the invention shown in FIGS. 3 through 6.
Figure 8C:
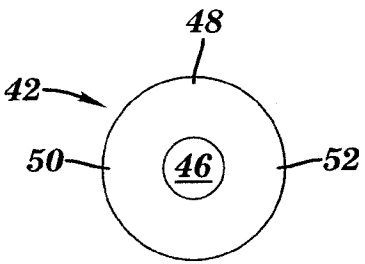
FIG. 8C is a bottom view of the pin shown in FIG. 8A.

FIG. 8A is a plan view of another pin 42 that can be used in the embodiment of the invention shown in FIGS. 3 through 6. FIG. 8B is a side elevation view of pin 42 shown in FIG. 8A. FIG. 8C is a bottom view of pin 42 shown in FIG. 8A. Pin 42 typically includes a shaft 44, a first end 46, and a second end 48, opposite the first end 46, and may have all the attributes of pin 18, for example, have the same range of dimensions and made from one or more of the materials referenced above. As shown in FIG. 8C, pin 42 may have a shaft 44 that is circular in cross section, though, shaft 44 may be non-circular, for example, oval or elliptical, in cross section. As shown in FIGS. 8A, 8B, and 8C, second end 46 similar to second end 20 of pin 18, may be blunt, or as shown in FIGS. 7A-7C second end 46 may be shaped with a reduced diameter, for example, beveled, to assist in inserting pin 42 into aperture 26 in ornament 12 and hole 16 in plate 14.

As shown in FIG. 8C, second end 48 of pin 42 may typically include at least one projection 50 providing a surface 52 against which ornament 12 may bear to retain ornament 12. For example, as shown in FIG. 8C, in one aspect, second end 22 may have an annular projection 50 providing a T-shaped appearance for pin 42. As shown in FIG. 8C, annular projection 50 may provide an annular surface 52, for example, a circular annular surface, but a non-circular surface may also be provided. In a similar fashion, projection 24 of pin 18 may also comprise an annular surface. In addition, second end 48 may be rounded, as shown, or otherwise contoured, for example, to provide a smooth, aesthetically attractive appearance to second end 48. In one aspect, second end 48 may not be rounded, but be substantially polygonal, for example, where pin 18 or pin 42 may have a substantially parallelepiped- or block-shaped second end 22 and 48, respectively.

Figure 9A:
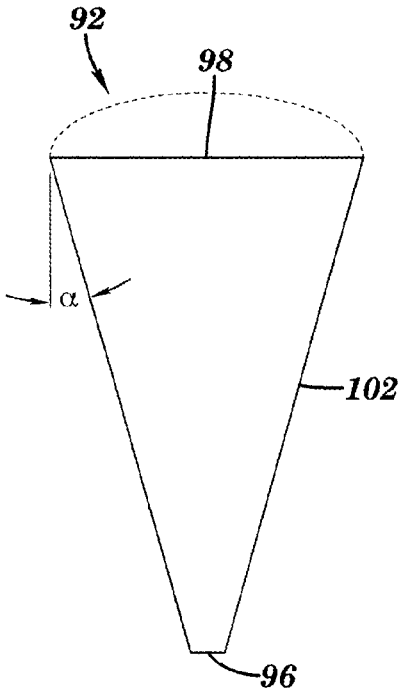
FIG. 9A is a plan view of another pin that can be used in the embodiment of the invention shown in FIGS. 3 through 6.
Figure 9B:
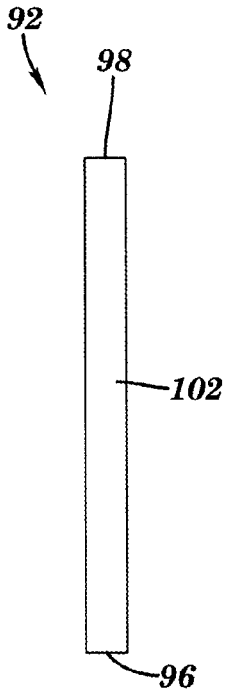
FIG. 9B is a side elevation view of the pin shown in FIG. 9A.
Figure 9C:
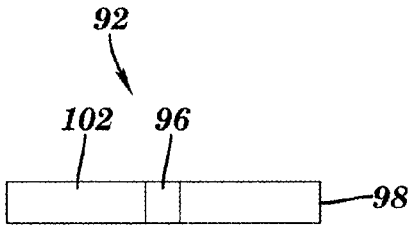
FIG. 9C is a bottom view of the pin shown in FIG. 9A.

FIG. 9A is a plan view of another pin 82 that can be used in the embodiment of the invention shown in FIGS. 3 through 6. FIG. 9B is a side elevation view of pin 82 shown in FIG. 9A. FIG. 9C is a bottom view of pin 82 shown in FIG. 9A. Pin 92 is triangular, tapered, or "wedge" shaped and typically tapers from a narrower first end 96 to a wider second end 98, opposite the first end 96. Pin 92 may have all the attributes of pin 18, for example, have the same range of dimensions and made from one or more of the materials referenced above. As shown in FIGS. 9A, 9B, and 9C, first end 96 similar to first end 20 of pin 18, may be blunt, or first end 96 may be shaped with a reduced diameter, for example, come to a point, to assist in inserting pin 92 into aperture 26 in ornament 12 and hole 16 in plate 14.

As shown in FIG. 9C, second end 98 of pin 82 may typically be wider in width where by pin 92 provides a surface 102 between first end 96 and second end 98 against which ornament 12 may bear to retain ornament 12. In one aspect, surface 102 may be a "projection" from of pin 82, as described and claimed herein, in which surface 102 functions to contribute to retaining an ornament on frame or plate 14. As shown in FIG. 9A, the taper of pin 92 may be defined by angle $\alpha$ between first end 96 and second end 98. The angle $\alpha$ may vary from about 1 to about 45 degrees, but is typically between about 5 and 15 degrees, for example, depending upon the geometry of the ornament mounting. In addition, first end 96 and/or second end 98 may be substantially flat or planer (as shown), rounded or radiused (shown in phantom), or otherwise contoured, for example, to provide a smooth, aesthetically attractive appearance to second end 98.

FIGS. 10A through 10F are plan views of frame holes 16 that can be used in the embodiment of the invention shown in FIG. 3. That is, FIGS. 10A through 10F illustrate some typical shapes of hole 16 that may be provided in plate 14 shown in FIG. 3 to receive pin 18 or 42 shown in FIGS. 7A-8C, respectively.

In one aspect of the invention, the geometry of pin 18 and hole 16 in plate 14 may minimize or prevent rotation of pin 18 in hole 16, for example, when pin 18 is deformed, for instance, twisted. For example, in one aspect, the geometry of hole 16 may be non-circular and interfere with the rotation of pin 18. As shown in FIG. 10A, hole 16 in plate 14 may be polygonal in shape, for example, square or rectangular, that is, non-circular. For example, the shape of hole 16 may mimic the shape of the cross section of pin 18 or pin 42, though be somewhat larger. In one aspect, hole 16 may prevent the rotation of pin 18 or pin 42 about its axial axis in hole 16, for example, hole 16 may be non-symmetrical, whereby the sides of hole 16 interfere or prevent the rotation of pin 18 in hole 16. This can be an effective means of assisting in the deformation of the second end 22 of pin 14. As shown in FIG. 10B, hole 16 may also be circular or round in shape, for example, similar in shape to pin 42 shown in FIGS. 8A-8C. As show in FIGS. 10C, 10D, 10E, and 10F, hole 16 may be non-circular, for example, substantially square, substantially triangular, substantially elliptical, or substantially hexagonal in shape, respectively. Other shapes, for example, polygonal shapes, for hole 16 will be apparent to those of skill in the art.

As shown in FIGS. 10A and 10B, hole 16 may have a typical dimension 15, for example, width or diameter, ranging from about 0.5 mm to about 13 mm, but is typically about 0.6 mm to about 2.1 mm. As shown in FIG. 10A, hole 16 may also have a thickness 17 from about 0.5 mm to about 13 mm, but is typically about 0.6 mm to about 2.1 mm. Similar dimensions may apply to the shapes shown in FIGS. 10C-10F.

The thickness of frame or plate 14 may range from about 0.5 mm to about 13 mm, but is typically about 1 mm to about 2 mm. Frame 14 may be made from any structural material, for example, a metal, a plastic, or even wood. For example, in one aspect where frame 14 is metallic, and frame or plate 14 may be made from iron, steel, stainless steel, aluminum, titanium, nickel, magnesium, brass, bronze, or any other structural metal, but may also be made from a precious metal, such as, copper, silver, or even gold. Though aspects of the invention illustrated herein typically show a single plate 14, it is conceived that a plurality of plates, frames, or layers 14 may be used in aspects of the invention, for example, one plate or layer providing the desired aesthetic appearance, for instance, a silver plating, and a second plate providing the desired structural strength.

According to aspects of the invention, pin 18 (or pin 42 or pin 82) may be inserted through aperture 26 in ornament 12 and through hole 16 in frame 14 and then an end of pin 18 is somehow deformed, modified, or altered to engage pin 18 with frame 14 to prevent pin 18 from passing back through hole 16 in frame 14 whereby ornament 12 is retained on frame 14 by projection 24. FIGS. 11 through 18 illustrate typical means for deforming pin 18 or 42 to effect aspects of the invention.

Figure 11:
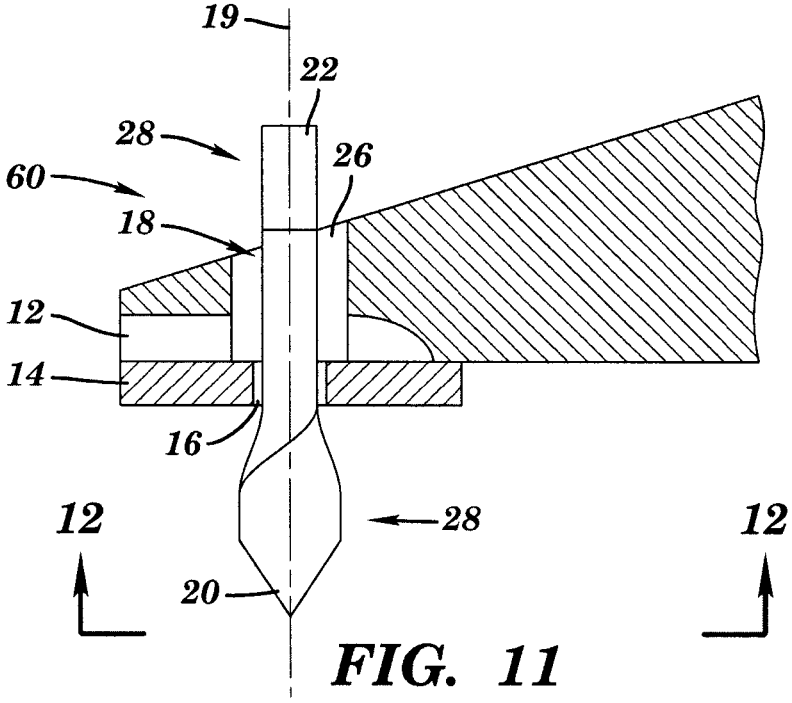
FIG. 11 is a cross sectional view of an engagement of a pin with a frame according to one aspect of the invention.
Figure 12:
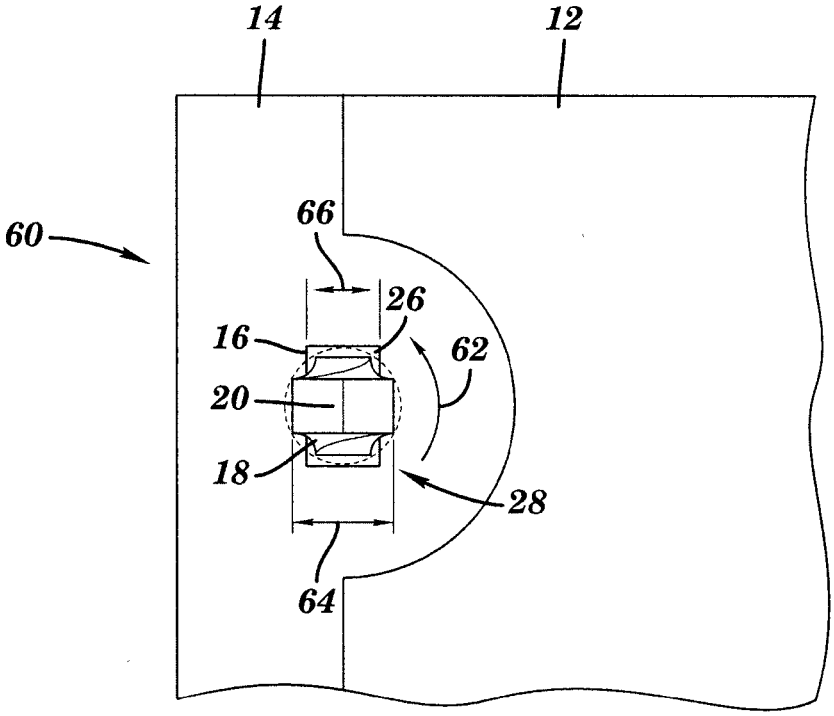
FIG. 12 is a plan view of the engagement shown in FIG. 11 as viewed along lines 12-12 in FIG. 11.

FIG. 11 is a cross sectional view of an engagement 60 of pin 18 with frame 14 according to one aspect of the invention. FIG. 12 is a plan view of engagement 60 shown in FIG. 11 as viewed along lines 12-12 in FIG. 11. As shown in FIGS. 11 and 12, in one aspect, after first end 20 of pin 18 is inserted through aperture 26 of ornament 12 and hole 16 of frame 14, first end 20 is provided with a deformation 28. Deformation 28 typically has a radial dimension greater than the diameter of hole 16 of frame 14 whereby deformation 28 restricts, for example, prevents, passage of first end 20 through hole 16. As shown in FIGS. 11 and 12, deformation 28 may comprise a twisting of first end 20, as indicated by arrow 62 in FIG. 12. According to one aspect of the invention, deformation 28 deforms first end 20 of pin 18 whereby a dimension 64 of first end 20 is greater than a dimension 66 of hole 16 in frame 14 whereby first end 20 is prevented from passing through hole 16. Deformation 28 may comprise a twisting or torsion of first end 20 of pin 18, by at least 5 degrees, about axis 19 pin 18, but is typically, a twist of at least 30 degrees, or at least about 90 degrees. For example, as shown in FIG. 12, deformation 28 may be a twist of about 90 degrees about axis 19 of pin 18, or more.

Figure 13:
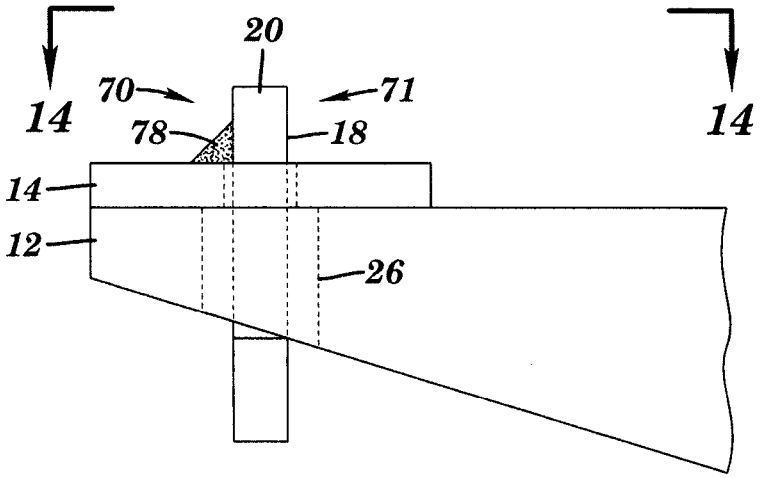
FIG. 13 is an elevation view of another engagement of a pin with a frame according to one aspect of the invention.
Figure 14:
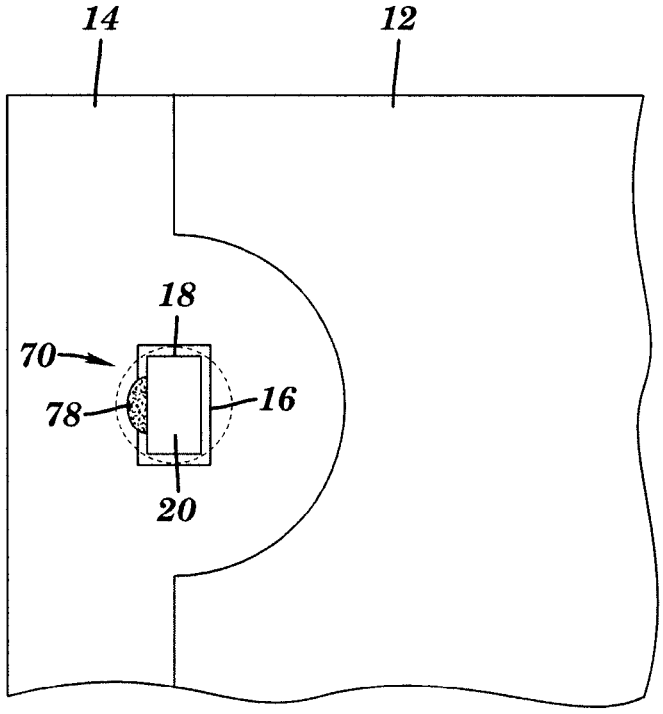
FIG. 14 is a plan view of the engagement shown in FIG. 13 as viewed along lines 14-14 in FIG. 13.

FIG. 13 is an elevation view of an engagement 70 of pin 18 with frame 14 according to another aspect of the invention. FIG. 14 is a plan view of engagement 70 shown in FIG. 13 as viewed along lines 14-14 in FIG. 13. As shown in FIGS. 13 and 14, in one aspect, after first end 20 of pin 18 is inserted through aperture 26 of ornament 12 and hole 16 of frame 14, first end 20 is provided with a deformation 78, for example, a portion of first end 20 or a portion of plate 14 may be fused, for example, welded, brazed, or soldered. In one aspect, first end 20 may be fused by heating a portion of first end 20 or a portion of plate 14 or both to cause the material of one or both to melt and fuse with the other. In another aspect, a weld, braze, or solder material, for example, a welding rod, may be introduced, heated, and melted to thermally fuse first end 20 and plate 14. The first end 20 of pin 18 may also be attached to plate 14 by means of an adhesive, such as, an epoxy or a glue. Deformation or weld 78 may typically be dimensioned to ensure the structural integrity of the fused material, for example, deformation 78 may typically be ¼ inch in dimension or smaller. Deformation 78 may simply be a small fused area, such as, a "tack weld," as needed.

Figure 15:
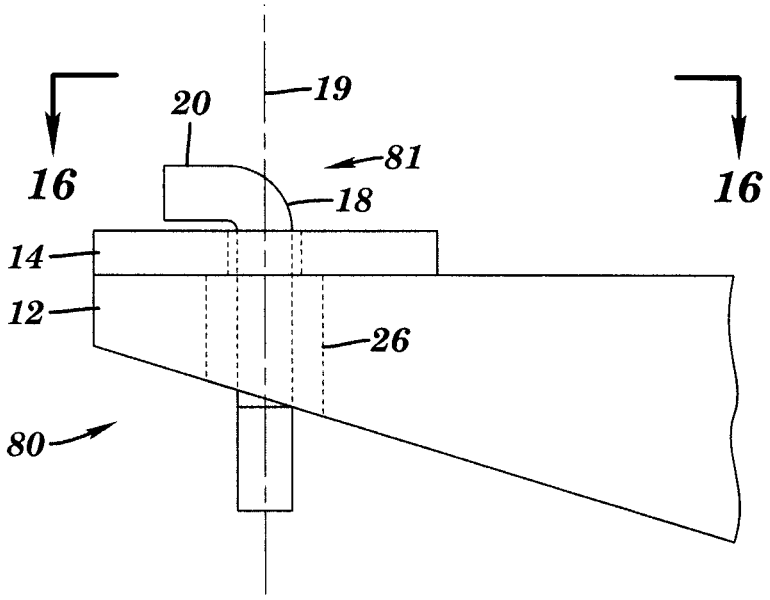
FIG. 15 is an elevation view of another engagement of a pin with a frame according to one aspect of the invention.
Figure 16:
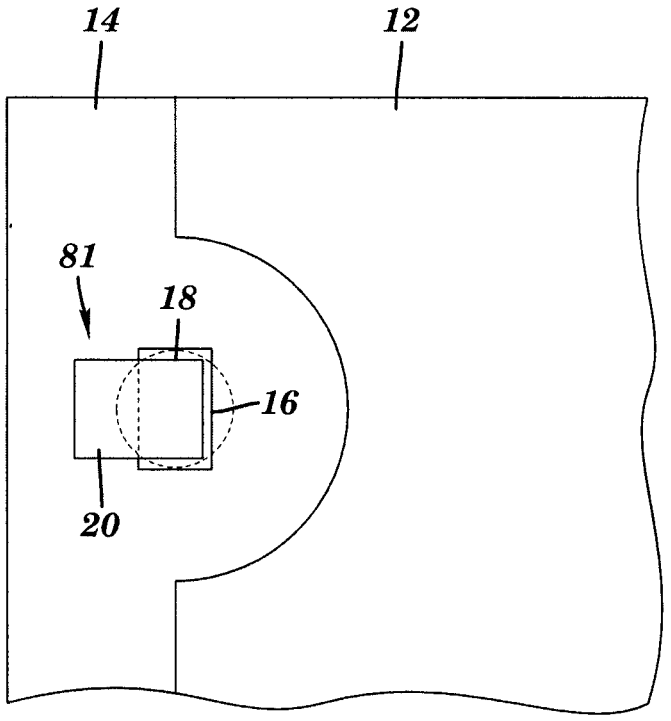
FIG. 16 is a plan view of the engagement shown in FIG. 16 as viewed along lines 16-16 in FIG. 15.

FIG. 15 is an elevation view of another engagement 80 of a pin 18 with a frame 14 according to one aspect of the invention. FIG. 16 is a plan view of the engagement 80 shown in FIG. 16 as viewed along lines 16-16 in FIG. 15. As shown in FIGS. 15 and 16, in one aspect, after first end 20 of pin 18 is inserted through aperture 26 of ornament 12 and hole 16 of frame 14, first end 20 is bent, for example, with an automated press or manually with a tool, to provide deformation 81. According to one aspect of the invention, deformation 81 comprises a deformation of first end 20 of pin 18 whereby when deformed a dimension of first end 20 is greater than a dimension of hole 16 in frame 14 whereby first end 20 is prevented from passing through hole 16. Deformation 81 may comprise a bending of first end 20 of pin 18 by at least 5 degrees in a direction substantially perpendicular to axis 19 pin 18, but is typically, a bending of at least 30 degrees, or at least about 90 degrees. For example, as shown in FIG. 15, deformation 81 may be a bending of about 90 degrees from axis 19 of pin 18. Though FIGS. 15 and 16 illustrate a bending of pin 18 in a direction substantially parallel to the plane of FIG. 15, in other aspects of the invention, pin 18 may be bent in any direction perpendicular to axis 19. For example, pin 18 may be bent in a plane substantially perpendicular to the plane of the sheet of FIG. 15, that is, into the figure and not parallel with the figure.

Figure 17:
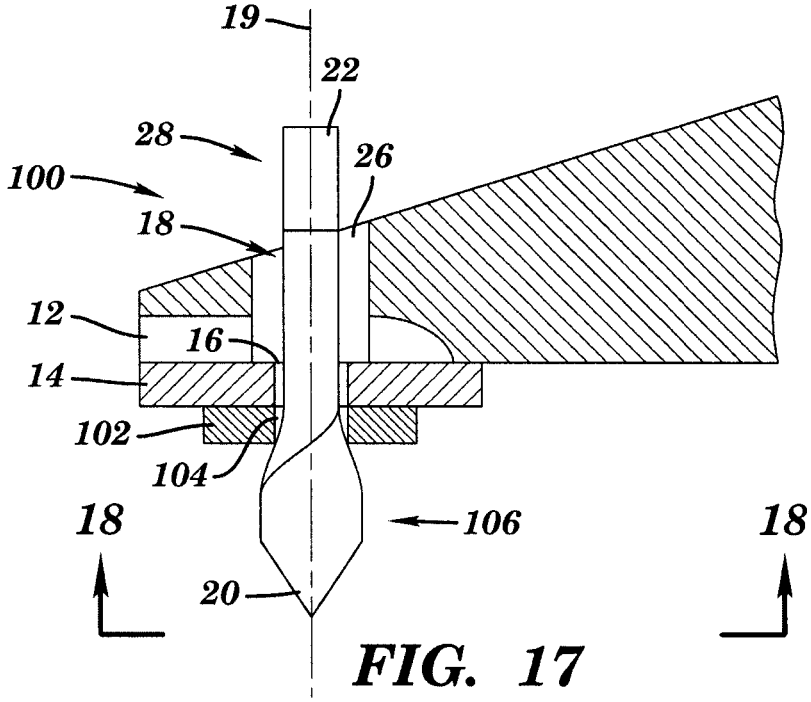
FIG. 17 is a cross section view of another engagement of a pin with a frame according to one aspect of the invention.
Figure 18:
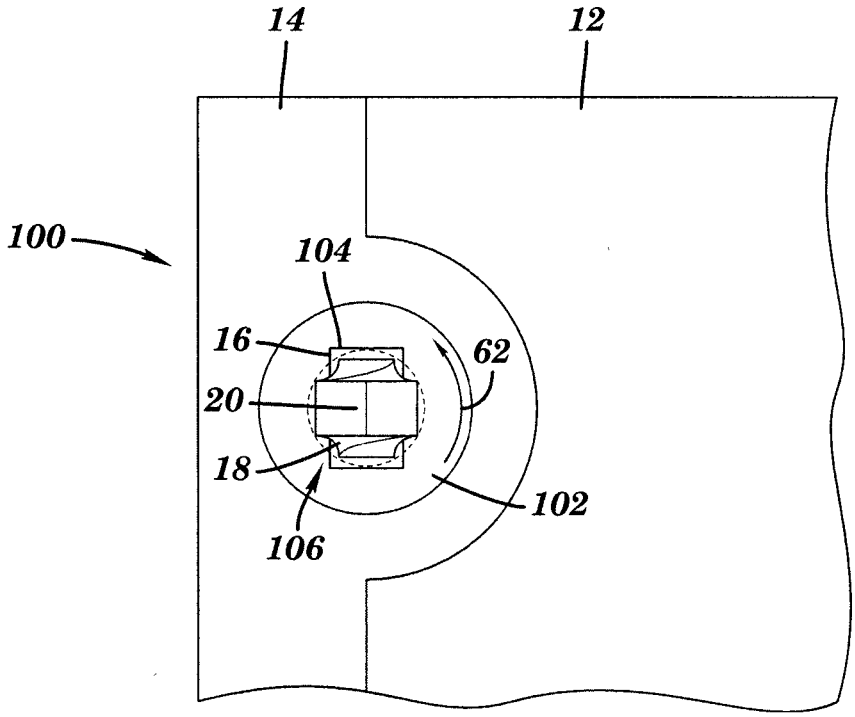
FIG. 18 is a plan view of the engagement shown in FIG. 17 as viewed along lines 18-18 in FIG. 17.

FIG. 17 is a cross section view of another engagement 100 of pin 18 with frame 14 according to one aspect of the invention. FIG. 18 is a plan view of the engagement shown in FIG. 17 as viewed along lines 18-18 in FIG. 17. As shown in FIGS. 17 and 18, in one aspect, engagement 100 includes an additional plate 102 have a hole 104 positioned adjacent to plate 14. Hole 104 may be circular or rectangular, or comprise any of the hole shapes shown in FIGS. 10A-10F. In this aspect of the invention, plate 102 may be used as a reinforcing or backing plate when frame 14 comprises a soft or incompatible material, for example, a material softer than the material of pin 18, such as, wood, plastic, or glass. Plate 102 provides a surface against which a deformation of pin 18 may bear or to which pin 18 may be adhered, for example, by a weld, a solder, or an adhesive. In one aspect, plate 102 provides a surface to adhere to, for example, weld, or glue, when plate 14 is incompatible with the mode of attachment. For example, when plate 14 cannot be fused to by a weld or solder, such as, when plate 14 is a wood, a plastic, or a glass. Though plate 102 may be made from any suitable material, plate 102 may typically be metallic, for example, steel or stainless steel. As shown in FIG. 18, plate 102 may be circular in shape, such as, a washer; however, plate 102 may be oval, square, rectangular, or any polygonal shape that performs the desired function, for example, with an aesthetic appearance.

According to aspects of the invention, as shown in FIGS. 17 and 18, after first end 20 of pin 18 is inserted through aperture 26 of ornament 12 and hole 16 of frame 14, first end 20 is then passed through hole 104 in plate 102. In a fashion similar to engagement 60 shown in FIGS. 11 and 12, first end 20 of pin 18 may be provided with a deformation 106. Deformation 106 may be a twisting as shown in FIGS. 11 and 12, but may also comprise the fusion or weld 78 shown in FIGS. 13 and 14 or the bending 81 shown in FIGS. 15 and 16. In any of these deformations, first end 20 of pin 18 is provided with a radial dimension greater than the width or diameter of hole 104 in plate 102 whereby the deformation restricts, for example, prevents, passage of first end 20 through hole 94.

Though the aspects of the invention illustrated in FIGS. 1-18 depict the mounting of a single ornament, it is also conceived that two or more ornaments 12 may be mounted to frame 14 according to aspects of the invention. For example, two or more ornaments 12 may be mounted one above the other to frame 14, that is, "sandwiched" together to frame 14. In addition, one or more ornaments may be mounted substantially end-to-end or concatenated by aspects of the invention, for example, to create a chain of two or more ornaments. According to aspects of the invention pin 18 may have a longer length than indicated above to accommodate passing through two or more ornaments 12 and one or more frames 14.

It will be apparent from the above discussion that aspects of the present invention provide novel methods, devices, and arrangements for mounting ornaments, for example, ornamental glass crystals, for instance, for ornamental fixtures, such as, light fixtures. Aspects of the present invention facilitate the mounting procedure and reduce the manipulations that characterize prior art methods and devices, such as, "pigtails," while providing an aesthetically pleasing and effective means for retaining ornaments.

While several aspects of the present invention have been described and depicted herein, alternative aspects may be effected by those skilled in the art to accomplish the same objectives. Accordingly, it is intended by the appended claims to cover all such alternative aspects as fall within the true spirit and scope of the invention.

The invention claimed is:

1. A method of retaining an ornament, the method comprising:

providing a pin having a first end and a second end, opposite the first end, the second end comprising a projection, the pin comprising a non-circular cross section;

inserting the first end of the pin through an aperture in the ornament and through a hole in a frame wherein the projection obstructs the aperture in the ornament;

deforming the first end of the pin to provide a deformation of the first end that obstructs passage of the first end through the hole in the frame, the deforming comprising twisting the first end of the pin about an axis of the pin;

retaining the ornament on the frame by the projection of the second end of the pin and the deformation of the first end of the pin; and wherein while twisting the first end of the pin, preventing rotation of the pin in the hole of the frame due to interference between the non-circular cross section of the pin and the hole in the frame.

2. A method of retaining an ornament, the method comprising:

providing a pin having a first end and a second end, opposite the first end, the second end comprising a projection;

inserting the first end of the pin through an aperture in the ornament and through a hole in a frame wherein the projection obstructs the aperture in the ornament;

deforming the first end of the pin to provide a deformation of the first end that obstructs passage of the first end through the hole in the frame;

retaining the ornament on the frame by the projection of the second end of the pin and the deformation of the first end of the pin; and wherein the deforming comprises fusing at least a portion of the pin with the frame.

3. The method as recited in claim 2, wherein the fusing comprises resistance welding.

4. A method of retaining an ornament, the method comprising:

providing a pin having a first end and a second end, opposite the first end, the second end comprising a projection;

inserting the first end of the pin through an aperture in the ornament and through a hole in a frame wherein the projection obstructs the aperture in the ornament;

deforming the first end of the pin to provide a deformation of the first end that obstructs passage of the first end through the hole in the frame;

retaining the ornament on the frame by the projection of the second end of the pin and the deformation of the first end of the pin; and wherein the deforming comprises fusing a material between at least a portion of the pin with the frame.

5. The method as recited in claim 4, wherein the material comprises one of a weld material, a brazing material, and a solder.

6. The method as recited in claim 4, further comprising preventing the pin from rotating within the hole of the frame.

7. A method of retaining an ornament, the method comprising:

providing a pin having a first end and a second end, opposite the first end, the second end comprising a projection;

inserting the first end of the pin through an aperture in the ornament and through a hole in a frame wherein the projection obstructs the aperture in the ornament;

preventing the pin from rotating within the hole of the frame;

deforming the first end of the pin to provide a deformation of the first end that obstructs passage of the first end through the hole in the frame;

retaining the ornament on the frame by the projection of the second end of the pin and the deformation of the first end of the pin; and wherein the preventing the pin from rotating within the hole of the frame comprises providing the pin with a non-circular cross section and providing the hole in the frame with a non-circular cross section.

8. The method as recited in claim 7, wherein the providing the pin with a non-circular cross section comprises providing the pin with a polygonal cross section and wherein providing the hole with a non-circular cross section comprises providing the hole with a polygonal cross section.

9. An apparatus for retaining an ornament, the apparatus comprising:

a frame having a hole;

a pin having a first end and a second end having a projection, the pin adapted to pass through an aperture of an ornament and through the frame hole wherein the first end extends out of the frame hole and the projection of the second end abuts the ornament;

a deformation of the first end of the pin that obstructs passage of the first end through the frame hole thereby retaining the ornament on the frame between the projection of the second end of the pin and the deformation of the first end of the pin, the deformation comprising a twisting of the first end of the pin about an axis of the pin;

means for preventing rotation of the pin in the hole of the frame comprising a surface of the hole; and wherein the surface of the hole is positioned to interfere with the rotation of the pin within the hole.

10. The apparatus as recited in claim 9, wherein the hole comprises a non-circular hole and the pin comprises a pin having a non-circular shaft, and wherein an internal surface of the non-circular hole interferes with the rotation of the non-circular shaft of the pin within the non-circular hole.

11. The apparatus as recited in claim 10, wherein the non-circular hole comprises a polygonal hole and the non-circular shaft comprises a polygonal shaft.

12. The apparatus as recited in claim 10, wherein the polygonal hole comprises a rectangular hole and wherein the polygonal shaft comprises a rectangular shaft.

13. An apparatus for retaining an ornament, the apparatus comprising:

a frame having a hole;

a pin having a first end and a second end having a projection, the pin adapted to pass through an aperture of an ornament and through the frame hole wherein the first end extends out of the frame hole and the projection of the second end abuts the ornament;

a deformation of the first end of the pin that obstructs passage of the first end through the frame hole thereby retaining the ornament on the frame between the projection of the second end of the pin and the deformation of the first end of the pin; and wherein the deformation comprises a fusing of the pin to the frame.

14. The apparatus as recited in claim 13 wherein the fusing comprises one of a weld, a soldering, and a brazing.

* * * * *